US006915864B2

(12) United States Patent
Itou et al.

(10) Patent No.: US 6,915,864 B2
(45) Date of Patent: Jul. 12, 2005

(54) CUTTER STRUCTURE FOR SHIELD MACHINE

(75) Inventors: Hiroyuki Itou, Kuwana (JP); Yuuichi Asai, Aichi (JP); Osamu Takagi, Musashino (JP); Kazuo Takamizawa, Koshigaya (JP); Fumio Kondou, Yao (JP); Hidetoshi Sakamoto, Osaka (JP)

(73) Assignees: Ishikawajima-Harima Heavy Industries Co., Ltd., Tokyo (JP); Taisei Corporation, Tokyo (JP)

( * ) Notice: Subject to any disclaimer, the term of this patent is extended or adjusted under 35 U.S.C. 154(b) by 95 days.

(21) Appl. No.: 10/226,747

(22) Filed: Aug. 22, 2002

(65) Prior Publication Data

US 2003/0094311 A1 May 22, 2003

(30) Foreign Application Priority Data

Nov. 21, 2001 (JP) ..... 2001-356199

(51) Int. Cl.[7] ..... E21B 7/00
(52) U.S. Cl. ..... 175/62; 299/60
(58) Field of Search ..... 175/53, 62; 299/55–62, 299/80.1; 405/138, 139, 141–147

(56) References Cited

U.S. PATENT DOCUMENTS 4,171,848 A * 10/1979 Ono ..... 299/1.3
5,032,039 A * 7/1991 Hagimoto et al. ..... 405/141
5,697,676 A * 12/1997 Kashima et al. ..... 299/60
6,382,732 B1 * 5/2002 Tanaka et al. ..... 299/55

FOREIGN PATENT DOCUMENTS

JP 02-061291 3/1990 ..... E21D/3/00

OTHER PUBLICATIONS

Stack, B., "Handbook of Mining and Tunneling Machinery", 1982, Wiley & Sons Publication, Ch. 11.*

* cited by examiner

*Primary Examiner*—Zakiya Walker
(74) *Attorney, Agent, or Firm*—McCormick, Paulding & Huber LLP

(57) ABSTRACT

In a cutter structure for a shield machine which advances by boring through a tunnel wall from inside an existing tunnel, the shape of an excavating surface on a work face formed by a cutter is set so as to have a smaller curvature than or an equal curvature to the curve of a surface to be excavated on the outer face of the tunnel wall to be excavated. Since the shape of the excavating surface on the work face formed by the cutter is set by a curvature, upon advance of the shield machine by boring through the tunnel wall, the tunnel wall to be excavated, the shape of which is cylindrical, can be cut into by opening a hole which extends diametrically outward from the central portion of the cutter. As a result, the sections that are not cut into remain connected to the existing tunnel and will not enter the cutter chamber in lumps.

17 Claims, 8 Drawing Sheets

CUTTER STRUCTURE FOR SHIELD MACHINE

CROSS REFERENCES TO RELATED APPLICATIONS

This application is entitled to the benefit of Japanese Patent Application No. 2001-356199 filed on Nov. 21, 2001.

BACKGROUND OF THE INVENTION

1. Field of the Invention

The present invention relates to a cutter structure for a shield machine which advances by boring through the tunnel wall of an existing tunnel.

2. Description of the Related Art

The present inventors have cited the device shown in FIG. 8 as a conventional shield machine which advances by boring through a tunnel wall in the interior of an existing tunnel.

As is illustrated in the figure, this shield machine a is one in which a cylindrical advancing section ring c, which is mounted on the advance opening part of an existing tunnel b, and a cylindrical advancing seal e which is slidably fitted over a shield frame d, are connected, whereupon the shield machine a is propelled upward by a propelling jack g which is under a reaction force to an advancing stand f. Then, as shown in FIGS. 9 and 10, due to the rotation of a cutter h the shield machine a bores through an excavatable wall i which has an arc-shaped cross section and forms one part of the existing tunnel b, thereby advancing upward.

In the cutter structure of this shield machine a, the shape of the cutter h itself is flat, and the excavating surface, which is formed from bits j and mounted on the cutter h, is also flat. Hence, when the shield machine a bores through the excavatable wall with an arc-shaped cross section using the cutter h, the outer circumference portion of the cutter h precedes the central portion such that the excavatable wall i is cut into but the central portion remains intact.

Moreover, as the cutter h continues to excavate upward, the portion connecting the central portion to the existing tunnel b gradually becomes smaller. Hence, the central portion becomes prone to collapse due to light outside pressure (earth pressure) and may also collapse prior to cutting by the bits j, whereby lumps of earth may be taken into the cutter chamber inside the shield frame d. Lumps of earth taken into a cutter chamber cannot be discharged by an earth discharging device which is designed in order to discharge regular earth and sand, and therefore block the earth discharging device.

SUMMARY OF THE INVENTION

An object of the present invention is to provide a cutter structure for a shield machine in which a tunnel wall can be excavated diametrically outward from the central portion of the cutter, and in which portions not to be excavated can be prevented from entering the cutter chamber as lumps of earth.

In order to achieve this object, the present invention is a cutter structure for a shield machine which advances by boring through a tunnel wall in the interior of an existing tunnel, wherein the shape of the excavating surface on the work face formed by the cutter is set so as to have a smaller curvature than or an equal curvature to the curve of the surface to be excavated on the outer face of the tunnel wall to be excavated.

According to the shape of the excavating surface on the work face formed by the cutter of the present invention, the shape of the tunnel wall to be excavated is cylindrical, and therefore, during advance by boring through this tunnel wall, the tunnel wall can be cut into by opening a hole which extends diametrically outward from the central portion of the cutter. As a result, the portions that are not cut into remain connected to the existing tunnel so that lumps of earth do not enter the cutter chamber.

Furthermore, it is preferable that the cutter comprise a plurality of cutter spokes which extend radially from the rotational center of the cutter at a rearward incline in respect of the direction of advance and a plurality of bits which are mounted on the work face of the cutter spokes. In so doing, the cutter spokes themselves incline rearward, whereby the aforementioned excavating surface shape can be obtained without altering the height of each bit to any large extent.

DESCRIPTION OF THE PREFERRED EMBODIMENTS

An embodiment of the present invention will be explained based on the attached drawings.

Figure 1:
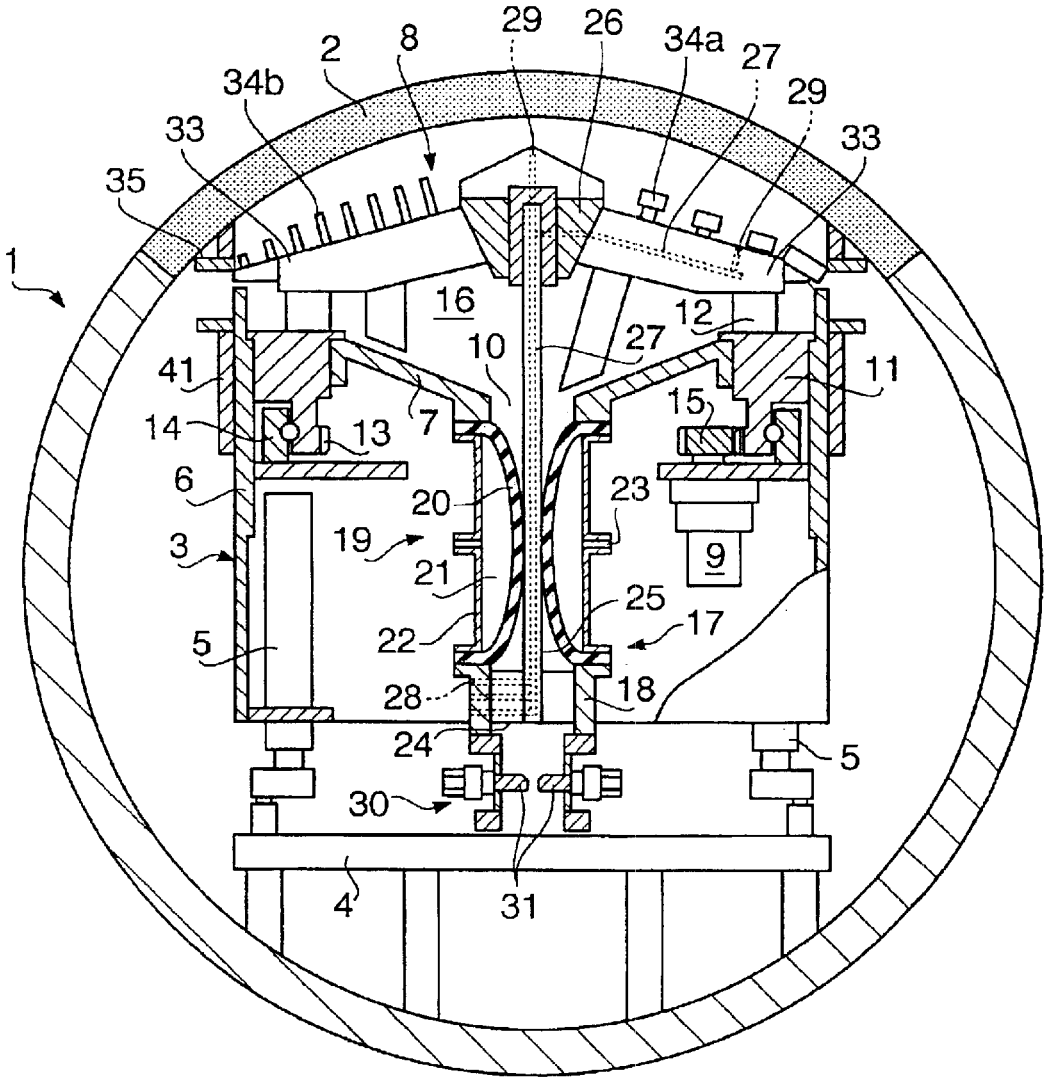
FIG. 1 is a side sectional view of a cutter structure for a shield machine according to an embodiment of the present invention.

As is illustrated in FIG. 1, a shield machine 3 which advances upward by boring through the ceiling part of a tunnel wall (excavatable wall 2) in the interior of an existing tunnel 1 is housed by being placed vertically on an advancing stand 4. This shield machine 3 comprises a tubular shield frame 6 which is placed facing upward on the advancing stand 4 via propelling jacks 5, a partition wall 7 which divides the upper work face side from the lower interior side, and a cutter 8 which is rotatably mounted on the partition wall 7. The jacks 5 are caused to extend, thereby causing the shield frame 6 to rise, and at the same time the cutter 8 is rotated by a motor 9 to advance upward from within the existing tunnel 1 by boring through the excavatable wall 2.

In more detail, the partition wall 7 is formed in a conical shape having an earth discharging port 10 in its central portion. Annular rotating bodies 11 are rotatably supported between the partition wall 7 and the shield frame 6. The cutter 8 is mounted on the upper surface of the rotating bodies 11 via support posts 12, and a ring gear 13 is provided on the lower surface of the rotating bodies 11. The ring gear 13 is axially supported by bearings 14 and meshed with a pinion 15 of the motor 9 so as to be rotationally driven. According to this constitution, the motor 9 is driven, whereby the cutter 8 rotates via the rotating bodies 11 such that the excavatable wall 2 or earth and sand from a piece of ground is excavated.

The excavatable wall 2 or earth and sand excavated by the cutter 8 is taken into a cutter chamber 16 on the upper side of the partition wall 7 and discharged downward by an earth discharging device 17 which is connected to the earth discharging port 10. The earth discharging device 17 is equipped with an earth discharging pipe 18 which is connected to the earth discharging port 10 and extends downward. The earth discharging pipe 18 is provided with an elastic film-type valve 19 which opens and closes the earth discharging pipe 18 by expanding and contracting diametrically by means of fluid pressure in air, water or the like.

The elastic film-type valve 19 is equipped with a tubular elastic film 20 (rubber film or the like) which is disposed at a point in the earth discharging pipe 18, a tubular casing 22 which is disposed so as to surround the elastic film 20 and forms a pressurizing chamber 21 with the peripheral surface of the elastic film 20, and a supply and discharge port 23 which is opened in the casing 22 for supplying and discharging fluid (air, water, etc.) into the pressurizing chamber 21. The elastic film-type valve 19 manages adjustments in the earth pressure at the work face by supplying and discharging fluid into and out of the pressurizing chamber 21 through the supply and discharge port 23 to cause the elastic film 20 to expand and contract diametrically, thus altering the sectional area of the space through which earth and sand pass so that the amount of earth to be discharged is adjusted during upward advance.

A bracket 24 which extends diametrically inward is provided in the earth discharging pipe 18 below the elastic film-type valve 19, and a center rod 25 which extends upward is attached to the bracket 24. The top of the center rod 25 is rotatably inserted into the central portion 26 of the cutter 8. A channel 27 for mud-forming agent is formed inside the bracket 24, center rod 25 and cutter 8. The mud-forming agent that is injected through an inlet 28 formed in the earth discharging pipe 18 passes through this channel 27 so as to be supplied to the work face from an outlet 29 formed in the cutter 8.

A gate mechanism 30 is provided in the earth discharging pipe 18 below the center rod 25. The gate mechanism 30 is equipped with a pair of gate plates 31, which are positioned close to each other with a space therebetween, and adjusts the sectional area of the space in the earth discharging pipe 18 through which the earth and sand pass. The gate mechanism 30 causes a substantially uniform earth pressure to act on the entire elastic film 20 by appropriately narrowing the sectional area of the space through which the earth and sand pass to cause a slight blockage in the earth and sand on the downstream side of the elastic film-type valve 19 and thereby raise the earth pressure. As a result, the elastic film 20 expands in a substantially uniform manner regardless of the drilling depth or type of soil being excavated, and thus earth pressure control at the work face can be securely performed.

Figure 2:
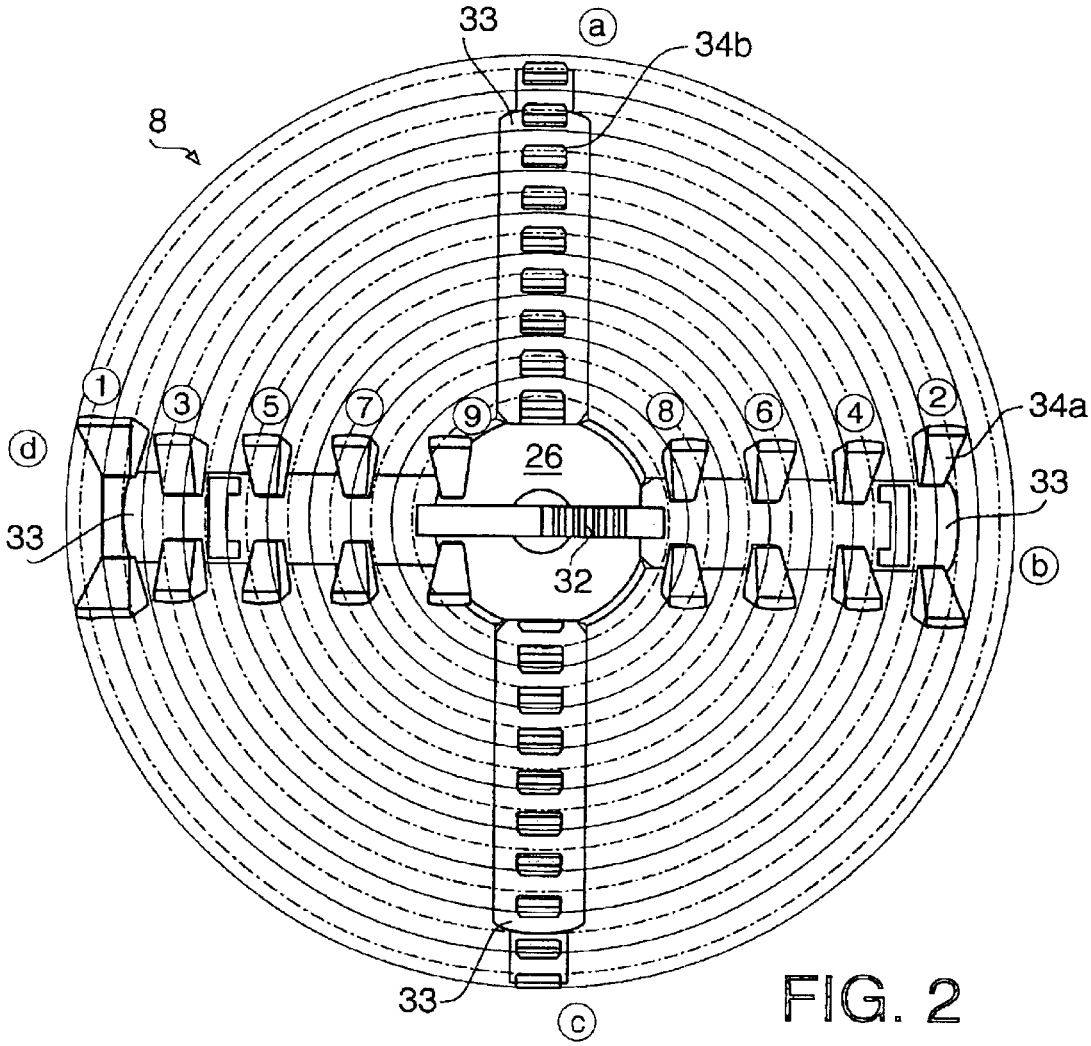
FIG. 2 is a front view of the aforementioned cutter.

The cutter 8 is rotationally driven by the aforementioned motor 9 so as to cut into the excavatable wall 2 when advancing from the existing tunnel 1 and so as to bore through the earth while advancing. As is illustrated in FIG. 2, this cutter 8 is equipped with a central portion 26 which is disposed in the center of rotation, a triangular center bit 32 provided in the central portion 26, a plurality of cutter spokes 33, which are attached to the rotating bodies 11 via the aforementioned support posts 12, and which extend radially rearward in respect of the direction of advance from the central portion 26 at an incline of a predetermined angle, and bits 34 attached to the work face side of each of the cutter spokes 33.

Figures 3A, 3B:
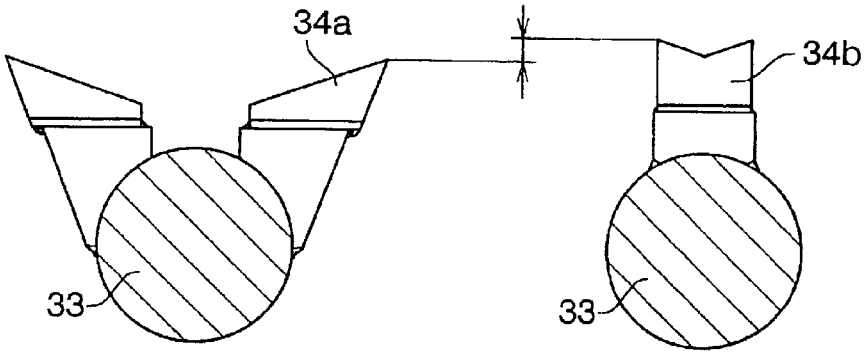
FIG. 3*a* is a sectional view of a cutter spoke of the cutter, illustrating a main bit.
FIG. 3*b* is a sectional view of a cutter spoke of the cutter, illustrating a preceding bit.
Figure 4:
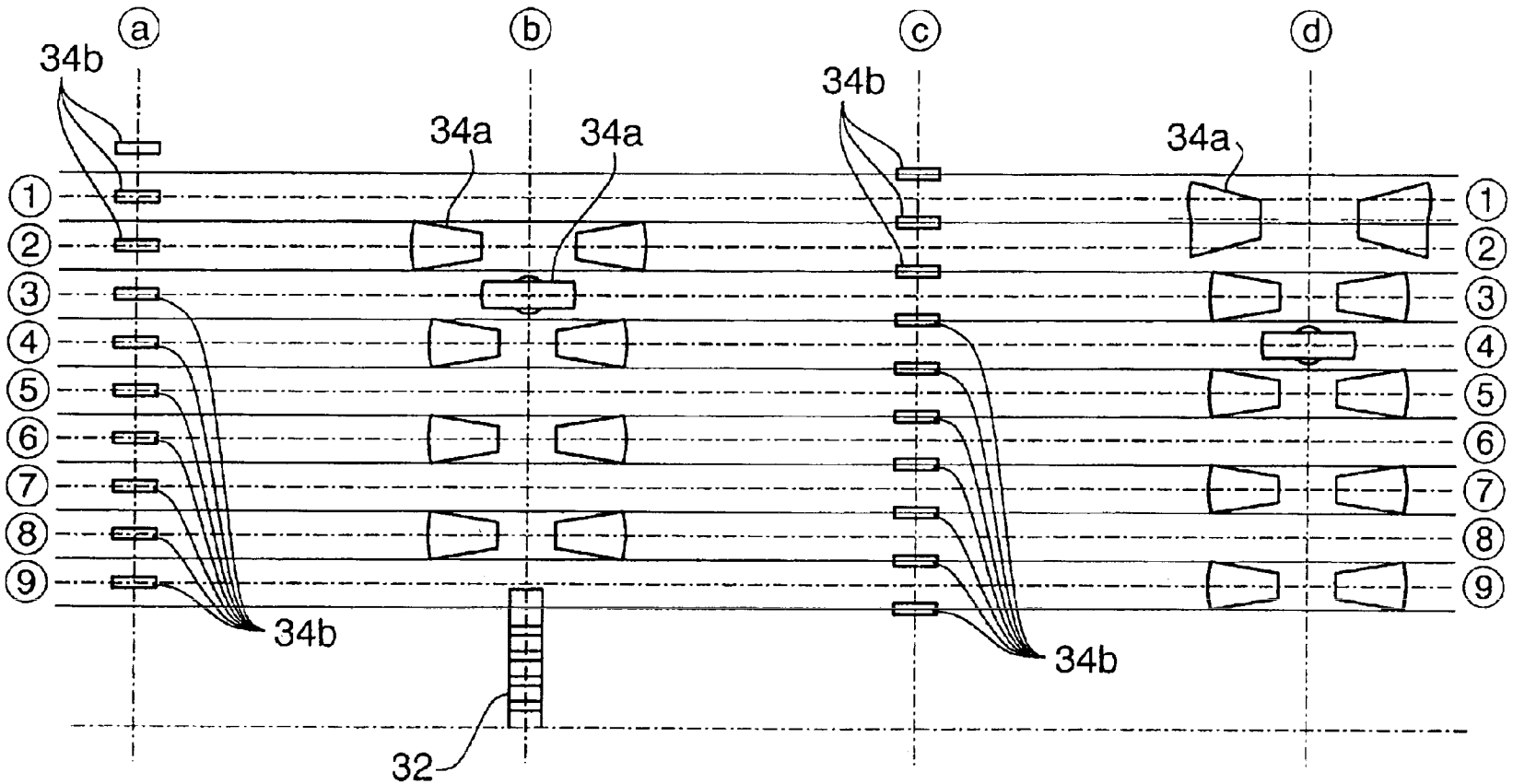
FIG. 4 is a diagram to explain the positional relationship of the preceding bits and main bits.

The bits 34 are comprised of main bits 34*a* and preceding bits 34*b*. The preceding bits 34*b* are formed in a tabular and elongated fashion along the direction of rotation of the cutter 8 and, as is illustrated in FIG. 3, have a higher predetermined height than the main bits 34*a*. The main bits 34*a* cut into the excavatable wall 2 concentrically before excavating the excavatable wall 2 in order to sever the arrangement of reinforcement, formed from carbon fiber or the like, therein. As is illustrated in FIG. 4, the main bits 34*a* are comprised of teeth bits disposed between each preceding bit 34*b*, and cut out the excavatable wall 2 between concentric grooves which are carved along the direction of rotation by the preceding bits 34*b*.

As is illustrated in FIG. 1, when the shield machine starts its advance, waterproofing is ensured by connecting a cylindrical advancing section ring 35 which is attached to the advance opening part of the excavatable wall 2 to a cylindrical advancing seal 41 which is slidably fitted over the shield frame 6. Then, as the shield machine advances by boring through the excavatable wall 2, the preceding bits 34*b* and the main bits 34*a* excavate the earth as described above, the preceding bits 34*b* carving concentric grooves onto the work face while the main bits 34*a* cut away the earth between these grooves.

Figure 5A:
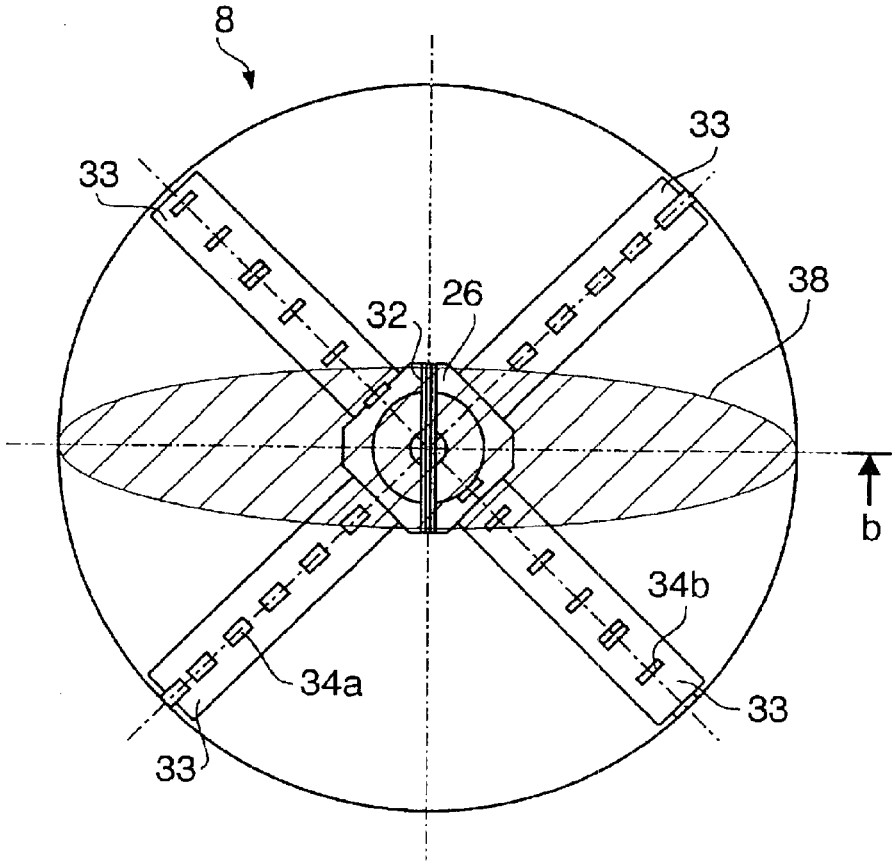
FIG. 5*a* is a top view illustrating the excavation condition of an excavatable wall by the cutter and bits.
Figure 5B:
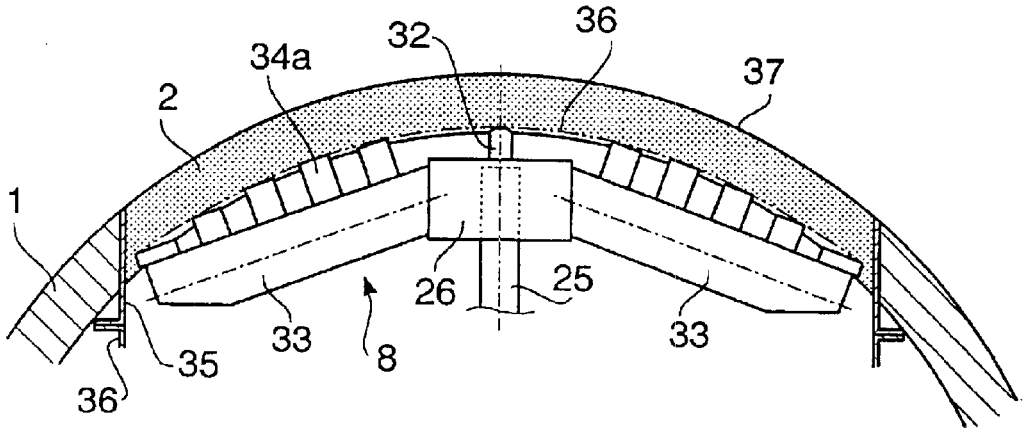
FIG. 5*b* is a sectional view (front sectional view) of line b—b in FIG. 5*a*.
Figure 6A:
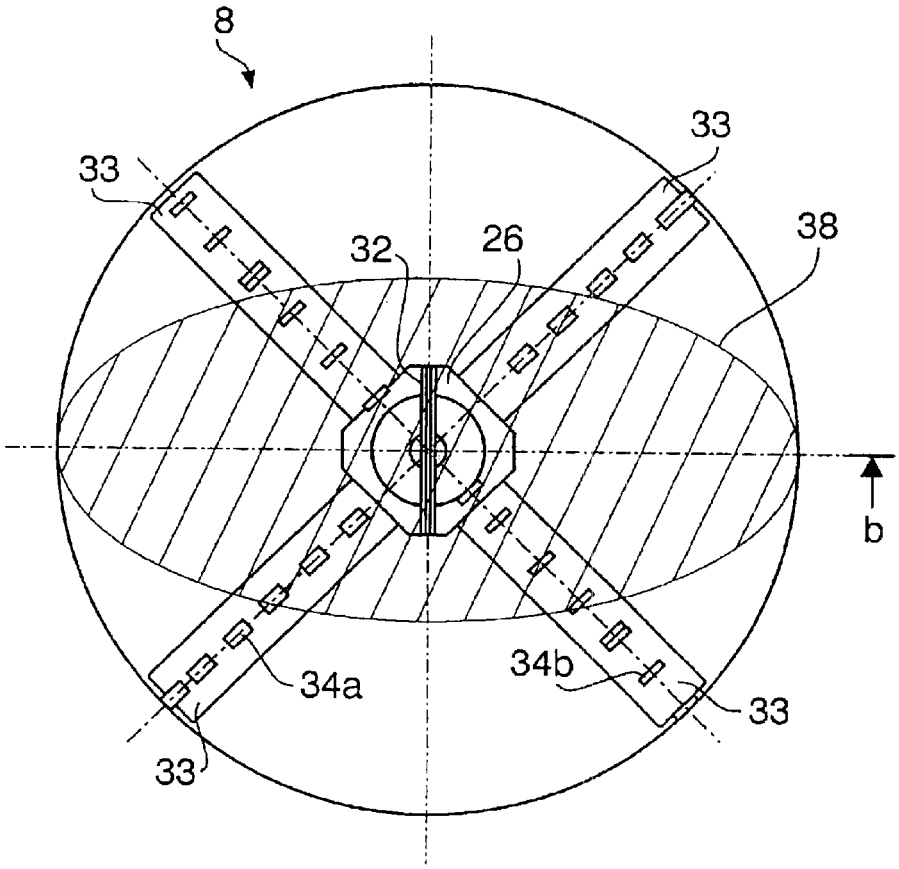
FIG. 6*a* is a top view showing a continuation of FIG. 5*a*.
Figure 6B:
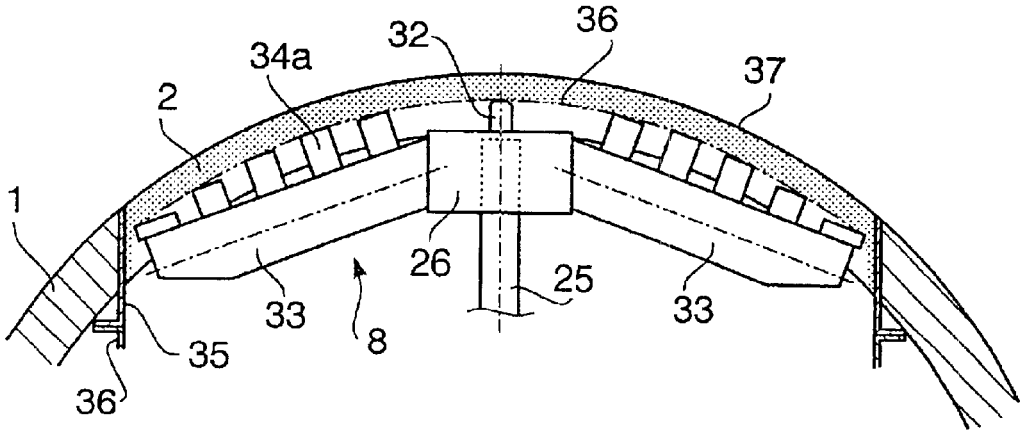
FIG. 6*b* is a sectional view (front sectional view) of line b—b in FIG. 6*a*.
Figure 7A:
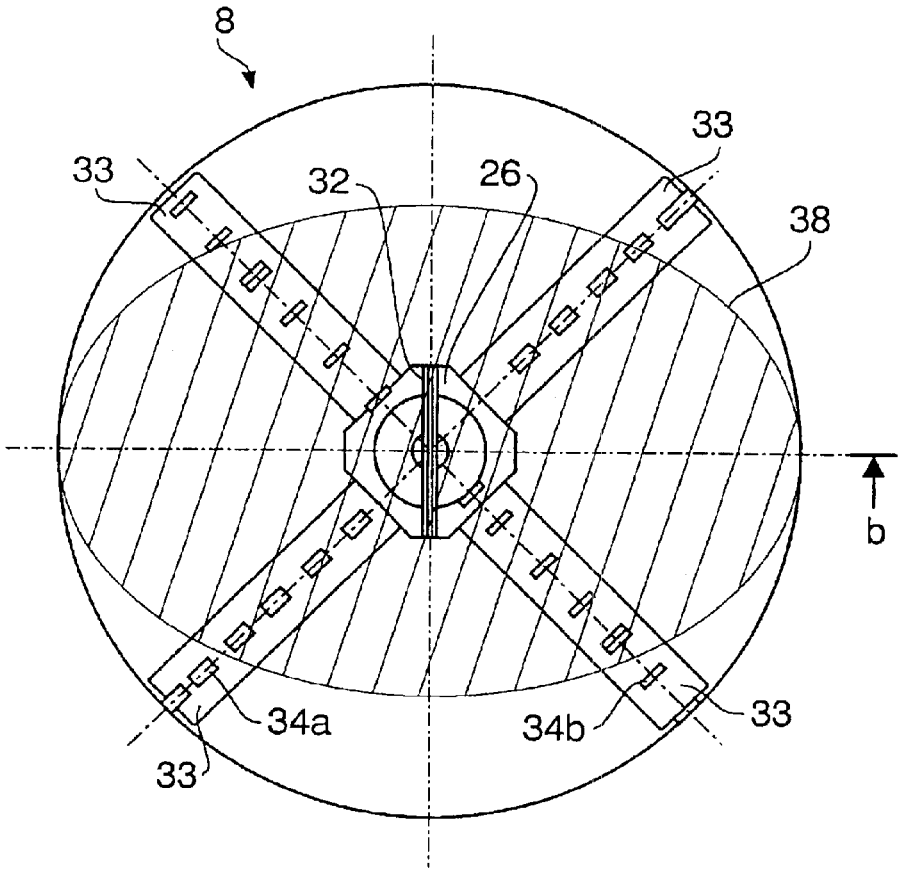
FIG. 7*a* is a top view showing a continuation of FIG. 6*a*.

As is illustrated in FIGS. 5 through 7, in the preceding bits 34*b* and the main bits 34*a*, the shape of the excavating surface 36 on the work face during rotation of the cutter 8 is set at a curvature which is smaller than or a curvature which is equal to the curve of the surface to be excavated 37 on the outer face of the tunnel wall to be excavated (the excavatable wall 2). The central portion of the cutter 8 may also be set in an arc shape with a protruding tip such that the central portion precedes in boring through the tunnel wall. In other words, the heights of each of the bits 34 mounted on the cutter spokes 33 differ slightly so as to form the aforementioned excavating surface 36 during rotation.

In the example in the drawings, the height of both the preceding bits 34*b* and the main bits 34*a* is set so as to form the excavating surface 36 (more specifically, the main bits 34*a* are slightly lower). This is so that the excavatable wall 2 is excavated little by little, and with good balance, by the bits 34*a* and 34*b*. However, the height of only the preceding bits 34*b* may be set so as to form the excavating surface 36. This is because the preceding bits 34*b*, which advance ahead of the main bits 34*a*, may be considered to cut into the excavatable wall 2 most substantially. It should be kept in mind, however, that in such a case the cutting load on the preceding bits 34*b* will increase.

The operation of the present embodiment will now be described.

As is shown in FIG. 1, when the shield machine 3 is caused to advance upward from within the existing tunnel 1, the advancing seal 41 is connected to the advancing section ring 35 of the excavatable wall 2, whereupon the cutter 8 is rotated using the motor 9 while the jacks 5 elongate to cause the machine 3 to rise. Thereby, as is illustrated in FIGS. 5, 6 and 7, the excavatable wall 2 is gradually cut away from its inner peripheral surface by the bits 34*a* and 34*b* that are mounted on the rotating cutter 8.

Here, since the excavating surface 36 of the work face formed by the rotation of the cutter 8 has a curved shape, the excavatable wall 2 to be excavated takes a cylindrical form, and therefore, as the machine 3 advances by boring through the excavatable wall 2, the bits 34*a* and 34*b* mounted on the cutter 8 cut into the excavatable wall 2 by opening an elliptical hole (shown by shading in the drawings) extending diametrically outward from the central portion of the cutter 8. As a result, as is shown in FIGS. 5 through 7, the uncut portions 38 on the edges of the elliptical hole remain connected to the existing tunnel 1 so that lumps of earth do not fall and enter the cutter chamber 16.

Figure 8:
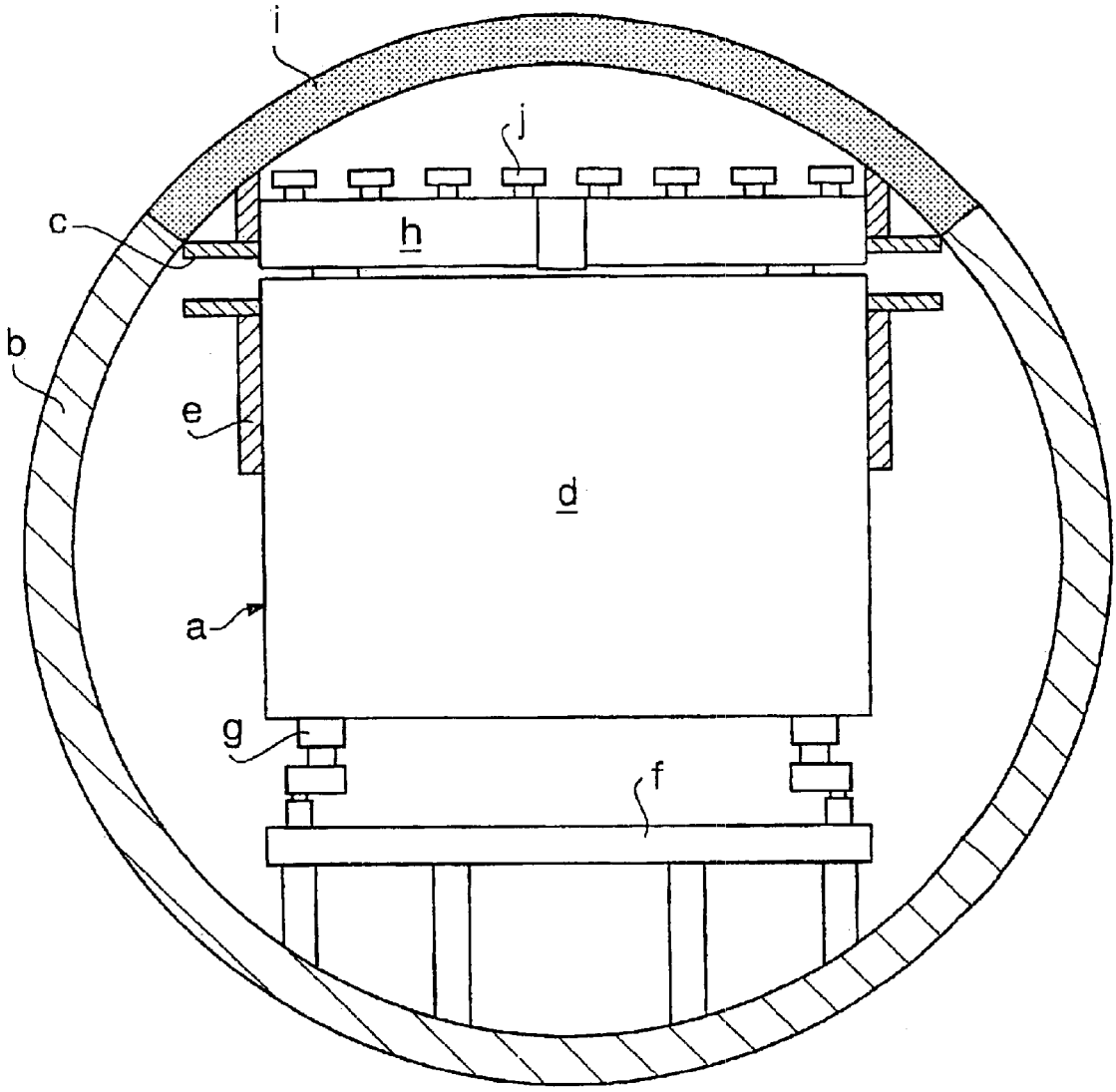
Prior Art FIG. 8
FIG. 8 is a side sectional view of a cutter structure for a shield machine disclosed previously by the present inventors.
Figure 9:
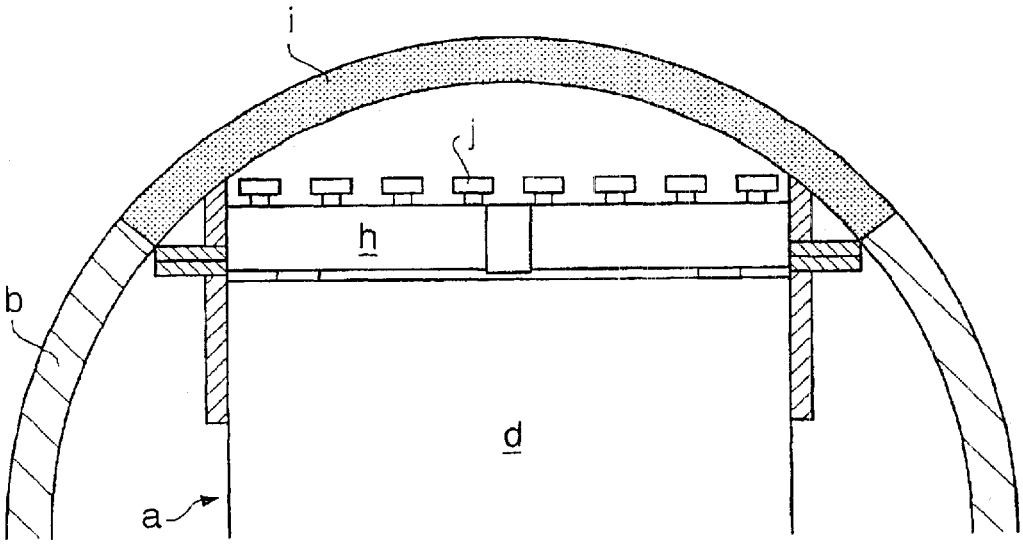
Prior Art FIG. 9
FIG. 9 is a view to explain the excavation condition of an excavatable wall by the cutter and bits.
Figure 10:
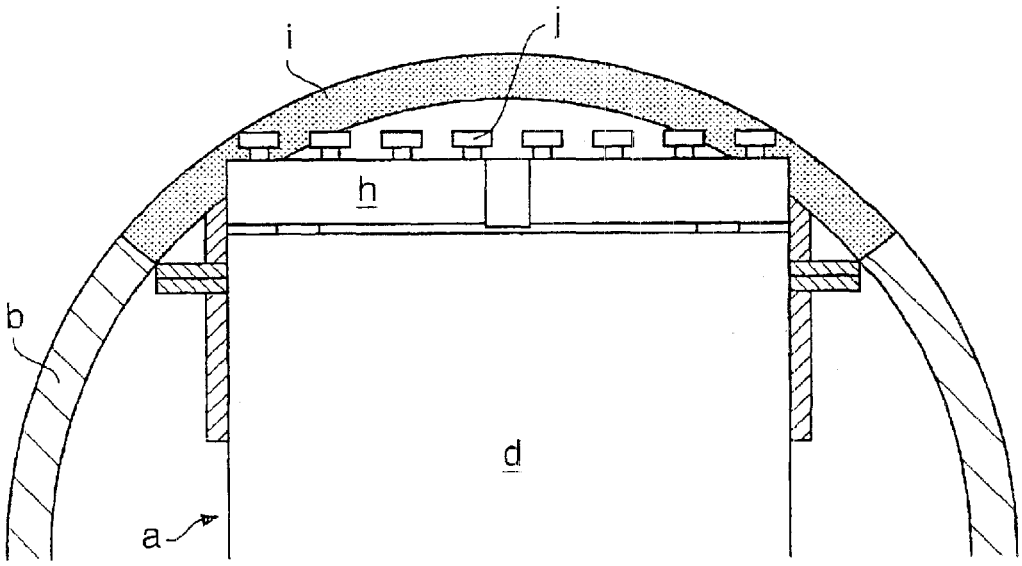
Prior Art FIG.10
FIG. 10 is a view to explain a continuation of FIG. 9.

In other words, by means of the aforementioned cutter 8 and bits 34, the excavatable wall i does not collapse in large lumps of earth which enter the cutter chamber 16, unlike the machine type shown in FIGS. 8 through 10. Instead, the excavatable wall 2 is cut by each of the bits 34 in a manner that allows only small shavings to enter the cutter chamber 16. As a result, the shavings of the excavatable wall 2 that enter the cutter chamber 16 can be easily discharged by the earth discharging device 7 which is pre-designed to discharge regular earth and sand.

More specifically, in the machine type shown in FIGS. 8 through 10, when the excavatable wall i falls into the cutter chamber 16 in large lumps, these lumps cannot be discharged if they are larger than the inner diameter of the earth discharging port 10. In this embodiment, however, as is illustrated in FIGS. 5 through 7, the excavatable wall 2 is cut by each bit 34 so as not to collapse and only small shavings are allowed to enter the cutter chamber 16. Thus, no lumps of earth that are larger than the inner diameter of the earth discharging port 10 enter the cutter chamber 16, and earth can always be securely discharged.

Figure 7B:
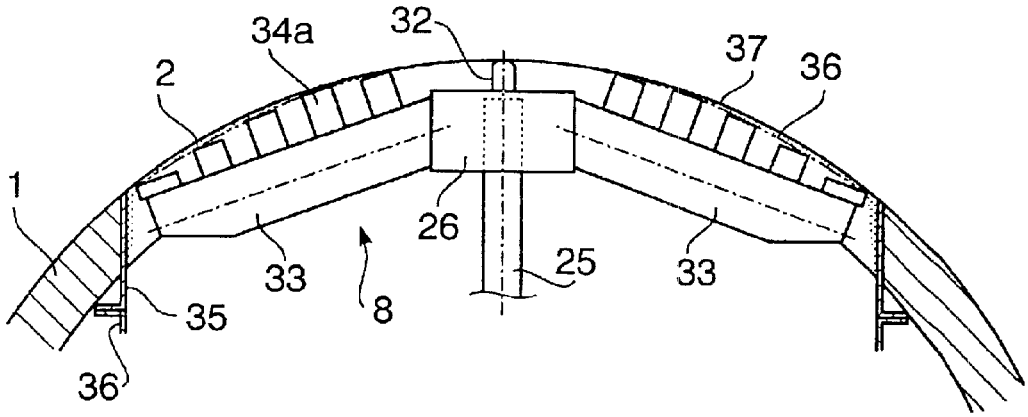
FIG. 7*b* is a sectional view (front sectional view) of line b-b in FIG. 7*a*.

Furthermore in this embodiment, as is shown in FIG. 7*b*, the form of the excavating surface 36 on the work face formed by the bits 34 of the cutter 8 is set to be almost equal to (very slightly sharper than) the curve of the surface to be excavated 37 on the outer surface of the excavatable wall 2. Therefore, the excavatable wall 2 can be excavated along the diametrical direction of the cutter 8 substantially simultaneously and with good balance. Also, the cutter spokes 33 incline rearward in respect of the direction of advance, and the bits 34 are mounted on the work surface of the cutter spokes 33, and hence the excavating surface 36 shape as described above can be obtained and the bits 34 can be supported more rigidly without altering the height of the bits 34 to any large extent.

Note that in this embodiment, a case was described in which the shield machine 3 advanced upward from within a lateral existing tunnel 1. However, the present invention can also be applied to cases in which the shield machine 3 advances laterally or downward. The present invention can also be applied to a case in which the shield machine 3 is caused to advance laterally from an existing vertical shaft. In short, the present invention is applicable as long as the shape of the excavating surface on the work face which is formed by the bits of the cutter is sharper than the curve of the surface to be excavated on the outer face of the tunnel wall to be excavated.

As described above, according to the cutter structure for a shield machine pertaining to the present invention, when the shield machine 3 advances by boring through the tunnel wall (excavatable wall 2) from within the existing tunnel 1, the tunnel wall 2 can be cut diametrically outward from the central portion of the cutter 8, whereby lumps of earth from the portion which is not cut into can be prevented from entering the cutter chamber 16. As a result, blockage of the earth discharging device 17 can be prevented.

Note that the present invention is not limited to or by the aforementioned embodiment, and may be implemented in modified form within the scope of the patent claims.

What is claimed is:

1. A cutter structure for a shield machine which advances by boring through a tunnel wall from within an existing tunnel, wherein the shape of an excavating surface on a work face formed by a cutter is set at a curvature which is smaller than or a curvature which is equal to the curve of a surface to be excavated on the outer surface of the tunnel wall to be excavated; and wherein said cutter comprises a plurality of cutter spokes which extend radially from the rotational center of said cutter at a rearward incline in respect of the direction of advance; and a plurality of bits which are mounted on the surface of each of the cutter spokes facing the work face.

2. The cutter structure for a shield machine according to claim 1, wherein said bits comprise: preceding bits which are formed in tabular form along the direction of rotation of the cutter; and main bits which are formed with a lower height than said preceding bits.

3. The cutter structure for a shield machine according to claim 2, wherein said preceding bits are disposed in a plurality at predetermined intervals in the diametrical direction of the cutter, and said main bits are disposed between these preceding bits.

4. The cutter structure for a shield machine according to claim 1, wherein said existing tunnel is provided with an excavatable wall which faces the cutter and is excavated by the cutter.

5. The cutter structure for a shield machine according to claim 4, wherein a cylindrical advancing section ring is provided at the advance opening part of said excavatable wall, and a cylindrical advancing seal which is connected to said advancing section ring at the start of advance is slidably fitted over a shield frame of the shield machine.

6. The cutter structure for a shield machine according to claim 5, wherein said excavatable wall is provided on the ceiling part of the existing tunnel, and said shield machine is placed vertically facing upward in the existing tunnel.

7. The cutter structure for a shield machine according to claim 1, wherein a triangular center bit is attached to the central portion of said cutter.

8. The cutter structure for a shield machine according to claim 1, wherein said cutter is rotatably supported on a partition wall which divides the interior of a tubular shield frame.

9. The cutter structure for a shield machine according to claim 8, wherein an earth discharging port is provided in said partition wall, and an earth discharging pipe is connected to this earth discharging port.

10. A cutter structure for a shield machine comprising: a tubular shield frame disposed vertically inside an existing tunnel; a partition wall which divides the interior of said shield frame into upper and lower regions; a cutter which is rotatably mounted on said partition wall; and an excavatable wall which is provided on the ceiling part of the existing tunnel so as to face said cutter, wherein the shape of the excavating surface formed by said cutter is set so as to have a smaller curvature than or an equal curvature to the curve of the surface to be excavated on the outer face of the excavatable wall.

11. The cutter structure for a shield machine according to claim 10, wherein said cutter is rotatably supported on the partition wall and comprises a plurality of cutter spokes which extend radially from the rotational center of said cutter at a rearward incline in respect of the direction of advance, and a plurality of bits which are mounted on the surface of each of the cutter spokes facing the work face.

12. The cutter structure for a shield machine according to claim 11, wherein said bits comprise preceding bits which are formed in tabular form along the direction of rotation of the cutter, and main bits which are formed with a lower height than said preceding bits.

13. The cutter structure for a shield machine according to claim 12, wherein said preceding bits are disposed in a plurality at predetermined intervals in the direction of diameter of the cutter, and said main bits are disposed between these preceding bits.

14. The cutter structure for a shield machine according to claim 10, wherein the cylindrical advancing seal is slidably fitted over said shield frame, and an advancing portion ring formed with the same diameter as said advancing seal is provided on said excavatable wall.

15. A method of advancing a shield machine in which said shield machine advances by boring through a tunnel wall from inside an existing tunnel, wherein the shape of an excavating surface formed by the rotation of a cutter is set so as to have a smaller curvature than or an equal curvature to the curve of a surface to be excavated on the outer face of a tunnel wall to be excavated, and the tunnel wall to be excavated is cut into so as to open a hole in an outward diametrical direction from the rotational center of the cutter;

said cutter bores through an excavatable wall provided in the tunnel wall; and said cutter is provided with preceding bits which are formed in tubular form along the direction of rotation of the cutter and main bits which are formed with a lower height than said preceding bits, the arrangement of reinforcement within the excavatable wall is severed by the preceding bits, and the excavatable wall having a severed arrangement of reinforcement is cut into by the main bits.

16. The method of advancing a shield machine according to claim 15, wherein said preceding bits are disposed in a plurality at predetermined intervals in the direction of diameter, said main bits are disposed in a plurality between these preceding bits, concentric grooves are carved into the excavatable wall by the preceding bits in accordance with the rotation of the cutter, thereby severing the arrangement of reinforcement, and the main bits cut into the excavatable wall between the concentric grooves.

17. The method of advancing a shield machine according to claim 15, wherein a cylindrical advancing seal is slidably fitted over a shield frame of said shield machine, an advancing section ring is provided with the same diameter as the advancing seal on said excavatable wall, and at the start of advance, the advancing seal and the advancing section ring are connected.

* * * * *